US005496180A

United States Patent [19]

Fabian et al.

[11] Patent Number: 5,496,180

[45] Date of Patent: Mar. 5, 1996

[54] SURFACE MOUNTABLE CARD EDGE CONNECTOR

[75] Inventors: David J. Fabian, Mount Joy; Timothy L. Kocher, Camp Hill; Shane D. Northcraft, New Cumberland; Douglas R. Sarver, Millerstown; Mark R. Thumma, Oberlin, all of Pa.

[73] Assignee: The Whitaker Corporation, Wilmington, Del.

[21] Appl. No.: 223,895

[22] Filed: Apr. 6, 1994

[51] Int. Cl.[6] ..... H01R 9/09

[52] U.S. Cl. ..... 439/60

[58] Field of Search ..... 439/60, 62, 83, 439/637, 636, 326

[56] References Cited

U.S. PATENT DOCUMENTS

| | | | |
|---|---|---|---|
| 4,583,807 | 4/1986 | Kaufman et al. . | |
| 4,715,820 | 12/1987 | Andrews, Jr. et al. | 439/79 X |
| 4,969,829 | 11/1990 | Sato | 439/83 |
| 5,026,292 | 6/1991 | Pickles et al. | 439/108 |
| 5,040,999 | 8/1991 | Collier | 439/108 |
| 5,051,099 | 9/1991 | Pickles et al. | 439/108 |
| 5,052,936 | 10/1991 | Biechler et al. | 439/60 |
| 5,127,839 | 7/1992 | Korsunsky et al. | 439/79 |
| 5,137,454 | 8/1992 | Baechtle | 439/62 |
| 5,145,384 | 9/1992 | Asakawa et al. | 439/78 |
| 5,199,884 | 4/1993 | Kaufman et al. | 439/74 |
| 5,199,885 | 4/1993 | Korsunsky et al. | 439/79 OR |
| 5,201,664 | 4/1993 | Korsunsky et al. | 439/83 OR |
| 5,259,768 | 11/1993 | Brunker et al. | 439/60 |
| 5,269,707 | 12/1993 | Reichardt et al. | 439/630 |
| 5,277,597 | 1/1994 | Masami et al. | 439/83 |

*Primary Examiner*—Larry I. Schwartz
*Assistant Examiner*—Daniel Wittels

[57] ABSTRACT

A surface mountable electrical connector 10 for use with a circuit board 70 of the type having one or more rows 74,82 of closely spaced trace termini 76,84 on the mounting surface 72 of the board 70, the connector 10 including a housing 12 having one or more rows of closely spaced electrical terminal members 30,46 therein. The terminal members 30,46 include elongate arm portions 36,52 extending from the housing 12 to surface mount contact sections 38,54 at free ends thereof. Each terminal associated with an outer row 74 of circuit board termini 76 includes a portion immediately adjacent and inwardly from the contact section 38, which is abruptly directed away from the mounting surface 72 to minimize wicking of solder to a nearby inner row termini 84. Some terminal members 46 include a registration portion 56 proximate free ends thereof and directed upwardly away from the mounting surface 72 of the board 70, to be received in an associated recess 20 extending into the mounting face 18 of the housing 12, thereby maintaining the registration of the elongate arms 52 and the accurate spacing of the surface mount contact sections 54 during handling and mounting.

6 Claims, 4 Drawing Sheets

10
12
14
16
18
20
22
24
26
28
30
30
32
34
34
36
38
40
42
46
48
52
54
56
58
70
72
74
74
76
76
80
80
82
82
84
84
88
90
94

SURFACE MOUNTABLE CARD EDGE CONNECTOR

FIELD OF THE INVENTION

The present invention is related to surface mountable electrical connectors and more particularly to high density connectors.

BACKGROUND OF THE INVENTION

The electronic industry today requires high-speed electronic equipment that is relatively compact and densely packaged. Typically the equipment includes one or more mother and daughter board assemblies. To reduce board space and eliminate the need for throughholes it is desirable to provide electrical connectors and devices that can be mounted to circuit pads on the surfaces of the circuit boards. It is also desirable to provide high-speed card edge connectors having a controlled impedance that will essentially match the impedance of the circuit board. A high-speed card edge connector is one that can pass fast rise time signals without distorting or degrading that rise time. It is desirable, therefore, to control the impedance of the connector to reduce signal reflection caused by changes in the impedance in the pathways conducting the digital pulse. Impedance control also requires close spacing of ground and signal traces in interconnections. With the close spacing of the ground and signal terminal members within the housing and conductive traces within the board, it is also necessary to prevent cross-talk between the adjacent interconnections. U.S. Pat. Nos. 5,026,292 and 5,051,099 disclose high-speed card edge connectors having closely spaced ground contact members and signal contact members, each pair of signal contact members having associated ground contact member. The contact members in these patents have soldered tails that engage throughholes in a mother board. In order to accommodate the dense array of solder tails for the signal and ground contact members, the solder tails and the throughholes are arranged in staggered arrays. In the embodiments shown, the solder tail portions of adjacent signal and ground contact members have different configurations requiring four different signal contact members and two different ground contact members, which greatly increases the cost of manufacturing the connector.

SUMMARY OF THE INVENTION

The present invention is directed to an electrical connector that is surface mountable and provides a means for interconnecting a dense array of electrical terminal members to a circuit board of the type having an outer row of trace termini and inner row of trace termini closely spaced therefrom on the mounting surface of the board. For purposes of illustration, the invention will be described in terms of a high-speed card edge connector. It is to be understood, however, that the invention is not limited to the connector described herein.

In accordance with the present invention the electrical connector includes a dielectric housing having a mounting face and a mating face and at least one row of electrical terminal members extending therebetween. The terminal members are arranged adjacent to each other in a dense array, the terminal members including an elongate arm portion extending from the mounting face of the housing to surface mount contact sections at the free ends thereof associated with one of the trace terminus of the circuit board.

Each of the terminal members associated with an outer row of termini include a portion immediately adjacent to the surface mount contact section that is abruptly directed away from the mounting surface of the circuit board at least a selected distance above the spacing between the outer and inner rows of circuit board termini. The spacing minimizes wicking of solder at the termini thereby preventing solder from wicking from the elongate arm to closely adjacent ones of the termini of the inner row.

In the embodiment shown, other terminal members associated with inner row of termini on the circuit board include a registration section on the elongate arm portion. The registration section is retained in a recess extending into the housing from the mounting face thereof adjacent the outer sidewalls and proximate the free ends of the terminal members. The registration section holds the free ends of the other terminal members in a registered spacing during the handling and mounting of the connector to the circuit board thereby preventing inadvertent engagement with closely spaced adjacent terminal members. In the embodiment shown the terminal members that engage the outer row of surface termini on the circuit board connect signal lines and the terminal members that engage the inner row of termini are connected to ground.

It is an object of the invention to provide a surface mountable connector designed to minimize the risk of solder being wicked to closely adjacent termini on the surface of the circuit board.

It is an additional object of the invention to provide a means for controlling the registered spacing of terminal members in a connector during the handling and mounting of the connector to the board.

It is a further object of the invention to provide a surface mountable connector having one or more rows of terminal members wherein soldered connections between contact surfaces at the free ends of the terminals and termini on the circuit board are accessible for reworking, i.e. soldering of a single connection using a soldering gun or the like, if necessary.

Another object of the present invention is to provide a surface mountable one-piece grounded high-speed connector.

Some of the objects and advantages of the invention having been stated, others will appear as the description proceeds when taken in connection with the accompanying drawings.

DETAILED DESCRIPTION OF THE DRAWINGS

Figure 1:
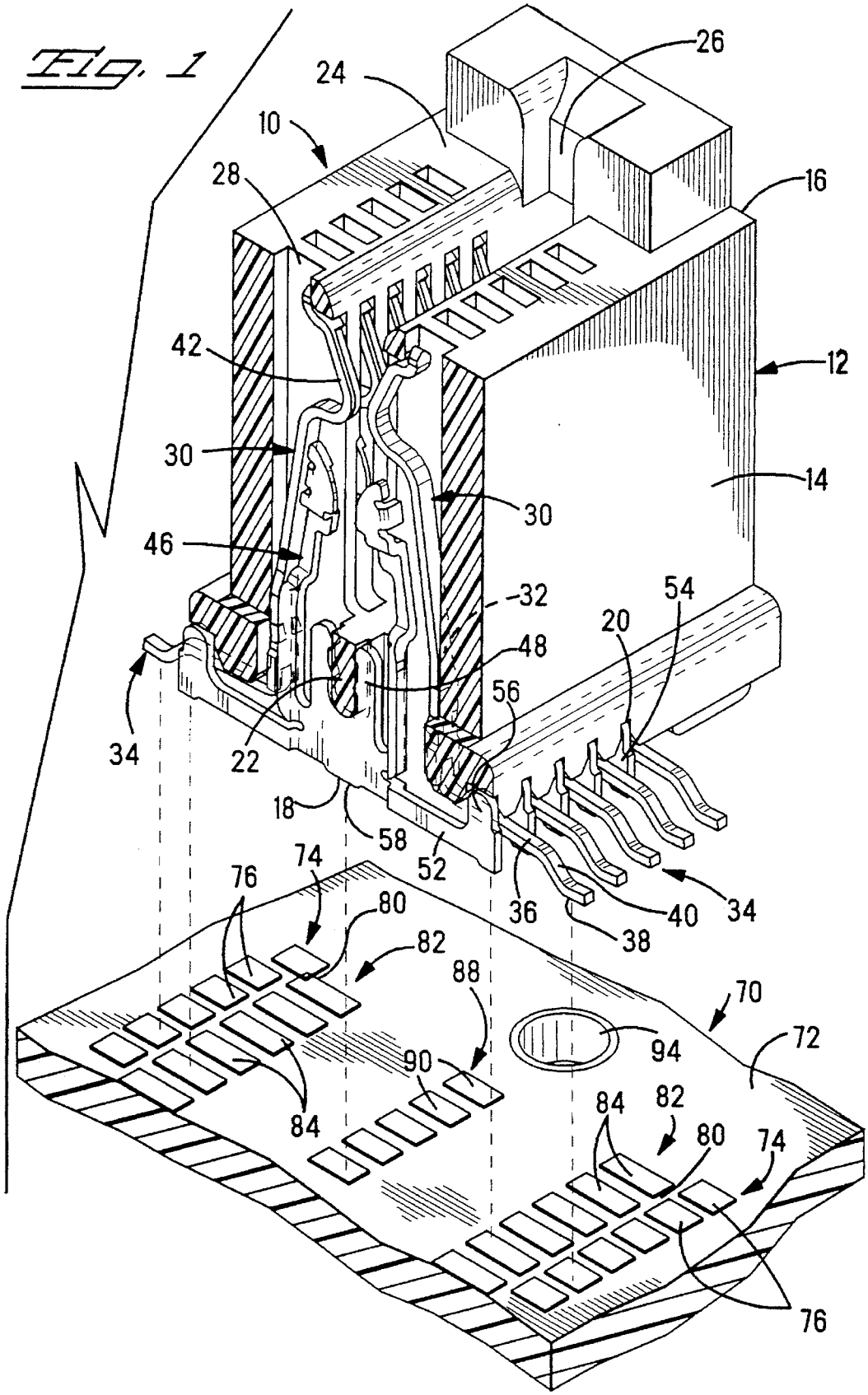
FIG. 1 is an exploded fragmentary perspective view of the connector of the invention exploded from the circuit board.

FIG. 1 shows an electrical connector 10 comprising a dielectric housing member 12 having a plurality of first and second terminal members 30,46 having respective surface mounted sections 38,54 to be mounted to respective termini 76,84 of circuit board 70. Dielectric housing member 12 has opposed sidewalls 14, endwalls 16, mounting face 18 and mating face 24. For purposes of illustrating the invention the connector shown is known as a high-speed card edge connector having alternating signal and ground terminal members and includes a card receiving slot 26. Housing 12 further includes a plurality of terminal receiving cavities 28 for receiving respective first and second terminal members 30,46 respectively. As shown in this embodiment, the first terminal members 30 are signal terminal members and the second terminal members 46 are ground terminal members. Housing 12 further includes an inner wall 22 on which is mounted ground contact 46.

Circuit board 70 includes a mounting surface 72 having a pair of outer rows 74, a pair of inner rows 82, and a center row 88 of surface termini 76,84,90 respectively. In the embodiment shown the outer row 74 of termini 76 are signal termini and the inner rows 82 of termini 84 are ground termini. In the preferred embodiment circuit board 70 further includes a center row 88 of ground termini 90. Circuit board 70 also includes mounting aperture 94 for securing a board lock such as 66 and alignment posts or the like (not shown) when connector 10 is mounted to the circuit board 70.

Figure 2:
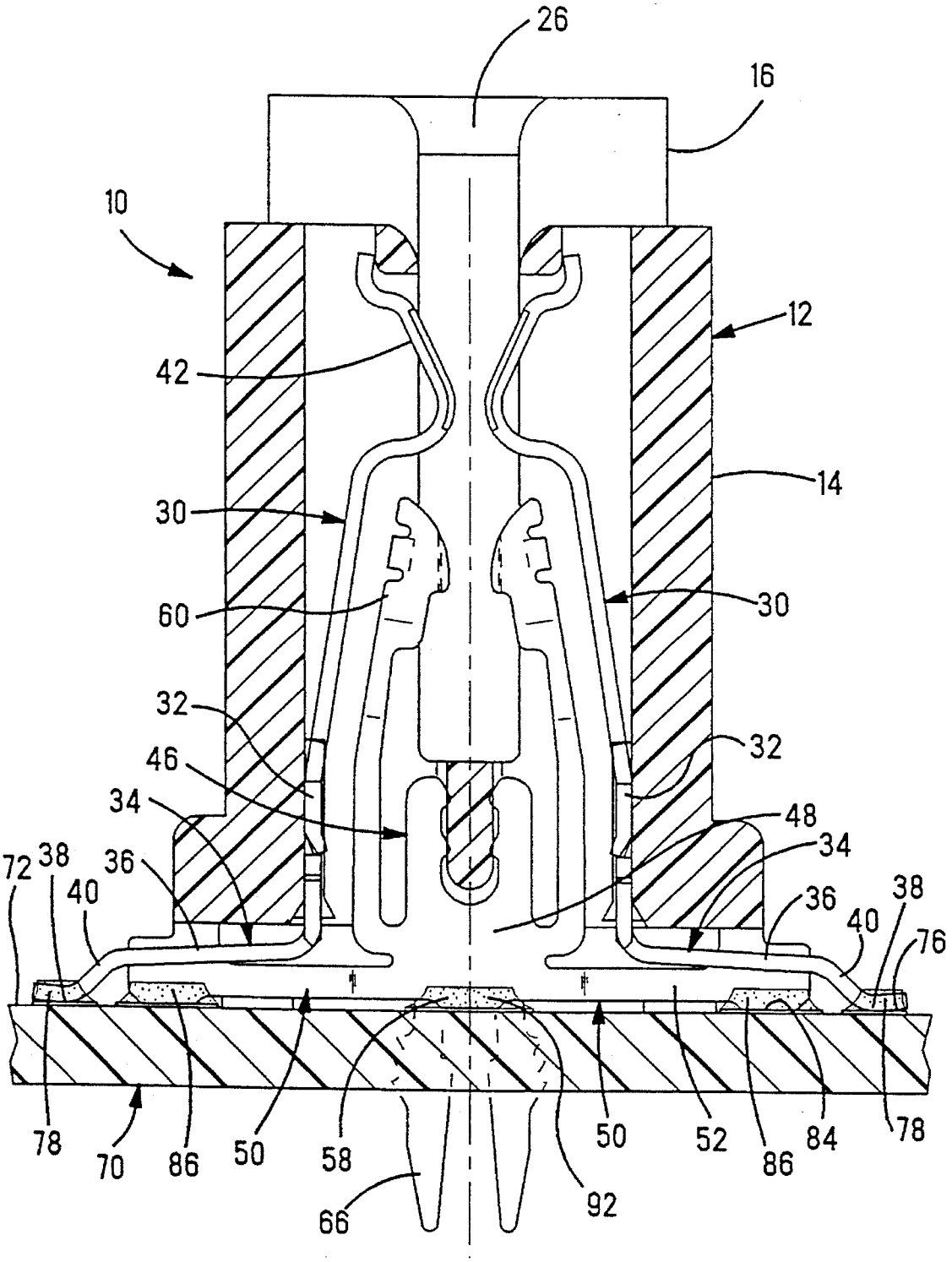
FIG. 2 is a cross-sectional view of the connector of FIG. 1 mounted to the circuit board and showing the array of terminal members soldered to the outer termini of the circuit board.
Figure 3:
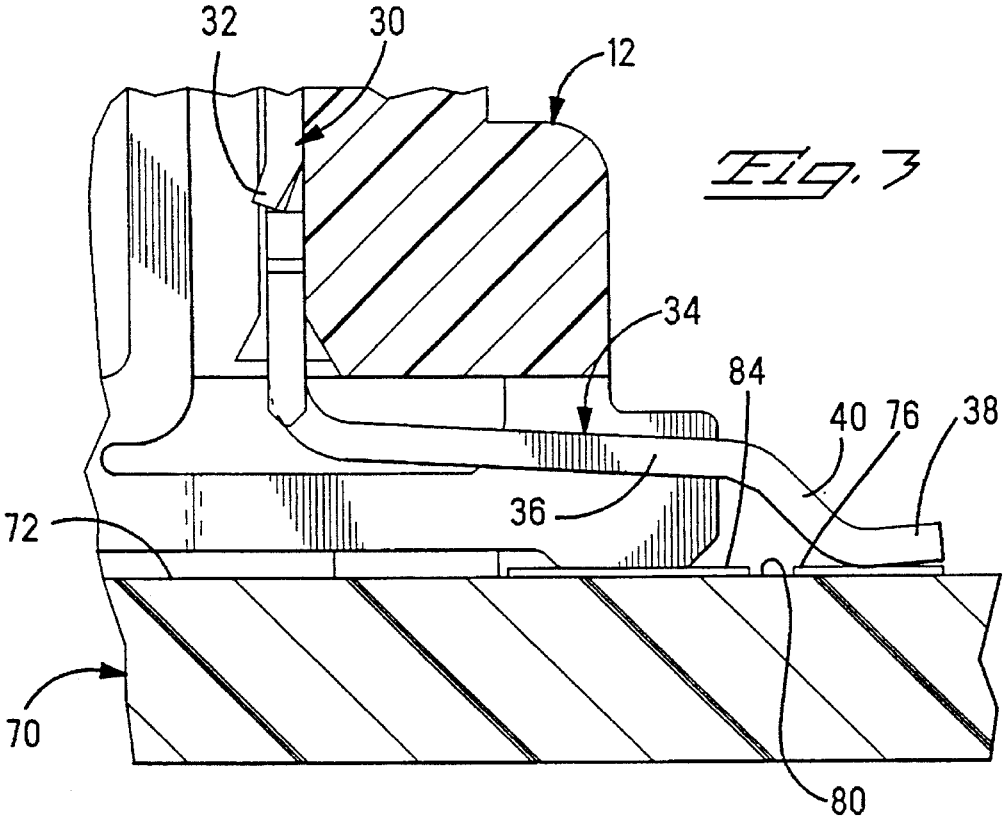
FIG. 3 is an enlarged fragmentary view of a portion of FIG. 2 illustrating the position of the terminal members to the outer termini.

Referring now to FIGS. 1, 2 and 3, the signal terminal members 30 include a body section 32 having a first contact portion 34 and a second contact portion 42. Terminal body 32 further includes means (not shown) for securing the terminal member 30 in housing 12. The first contact portion 34 of each terminal member 30 includes an elongate arm portion 36 extending outwardly from the mounting face 18 of the housing 12 to a surface mount contact section 38 at the free end thereof. Each surface mount contact section 38 is associated with a respective one of the signal trace termini 76 in outer row 74 of the circuit board 70. Each elongate arm portion 36 includes an angled portion 40 that concludes in surface mount contact section 38. Intermediate portion 40 is immediately adjacent the surface mount contact section 38 that is abruptly directed away from the mounting surface 72 of circuit board 70, as best seen in FIGS. 2 and 3, thus raising the remaining portion of arm 36 at least a selected distance above the spacing 80 between the inner and outer rows 74,82 of termini 76,84. As can be seen from these figures, elongate arms 36 and surface mount contact sections 38 extend generally parallel to the mounting face 18 of connector housing 12. FIG. 2 shows contact sections 38 electrically connected by solder 78 to respective termini 76. For purposes of clarity, solder 78 has been eliminated from FIG. 3. As can be seen in FIG. 3 it is critical that the spacing 80 between the first and second rows 74, 82 of termini 76,84 remains clear of solder to prevent shorting. The abrupt portion 40 of the elongate arm 36 raises arm 36 a sufficient distance above the inner termini row 82 thereby preventing the solder from wicking to the closely adjacent inner row 82 of termini 84. Preferably the intermediate portion elevates the elongate arm above the circuit board a distance that is greater than the thickness of the terminal.

Figure 4:
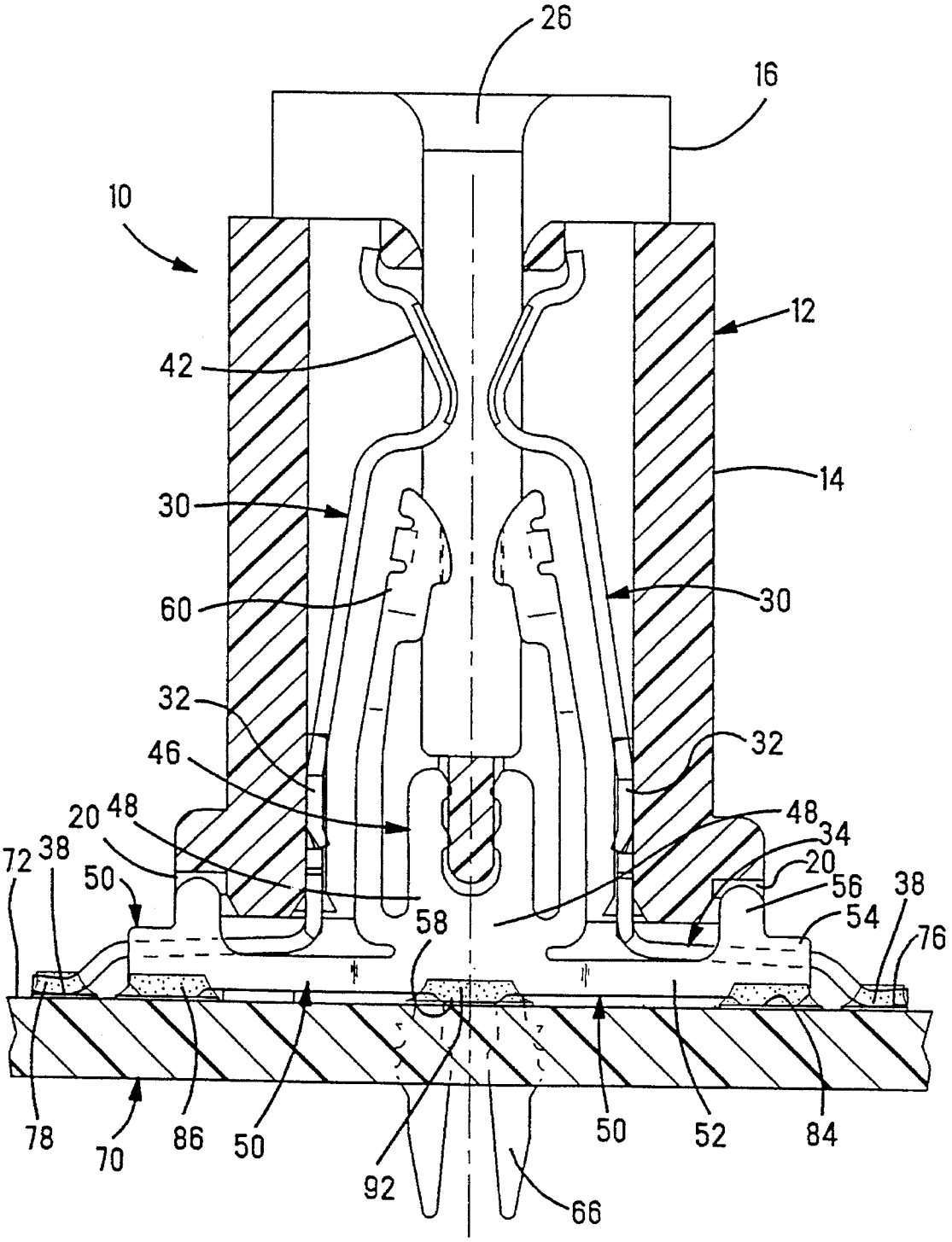
FIG. 4 is a cross-sectional view of the connector of FIG. 1 mounted to the circuit board and illustrating the terminal members connected to the inner row of termini of the circuit board.
Figure 5:
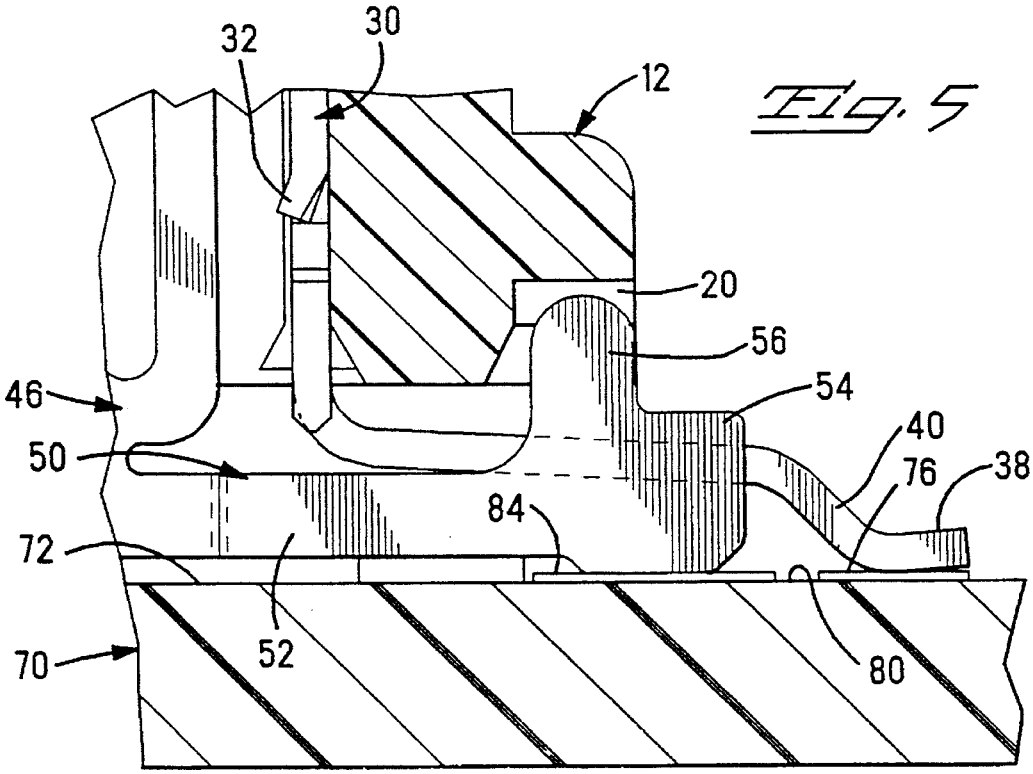
FIG. 5 is an enlarged fragmentary section of FIG. 4 illustrating the position of the terminal members to the inner row of termini.

Referring now to FIGS. 1, 4 and 5, the second terminal member 46 in the high-speed card edge connector 10 is a ground contact member having a body 48 secured to a wall 22 within housing 12 as described in U.S. Pat. Nos. 5,026,292 and 5,051,099. Terminal body 48 includes a first contact section 50 for engaging the circuit board 70 and a second contact section 60. The first contact section 50 includes an elongate arm 52 having a surface mount portion 54 at the free end thereof and a registration portion 56 extending in a direction opposite to the circuit board 70. Registration portion or tab 56 is engaged in retention slot 20 of housing 12. In the preferred embodiment the body 48 of ground terminal member 46 includes a pair of first contact sections 50 having respective elongate arms 52 extending in opposite directions to free ends, each having a surface mount contact section 54 for engaging a respective second termini 84 in the respective second termini rows 82. Registration portions 56 assure that the free ends 54 of the elongate arms 52 are retained in a registered spacing during the handling and mounting of connector 10 to board 70 thereby preventing inadvertent engagement with closely adjacent signal contacts. In the preferred embodiment body 48 of ground terminal member 46 further includes a middle contact or foot section 58 for engaging the surface mount termini 90 in center termini row 88 of circuit board 70. The middle contact or foot 58 also provides support for the continuously extending elongate arms 52 as well as provides a potential third interconnection site for the ground terminal member 46. FIG. 4 shows contact sections 54,58 electrically connected by solder 86,92 to respective termini 84,90. For purposes of clarity, solder 86 has been eliminated from FIG. 5.

As can best be seen in FIG. 4, the registration portions 56 which are received in housing recess or slots 20 maintain the continuously extending ground contact sections 50 in a true position along the mounting face 18 of the housing 12 thereby assuring that the three contact surfaces 54 at the free ends thereof and 58 at the center engage the respective termini 84,90,84 respectively. For optimum performance as a high speed connector, it is preferable that both of the contact surfaces 54 be soldered to their respective termini 84 on the board 70. It is to be recognized, however, that a minimum of one of the three surfaces 54,58,54 actually needs to be connected to the ground within the circuit board to effect grounding. The center surface 58 need not be electrically connected to a termini 90 on the board 70, it is desirable however, to have support at the center of the terminal member 46 to prevent stress being applied to solder fillets 86 at the outer edges 54 of the connector 10 when a card (not shown) is inserted into the card receiving slot 26 of connector 10.

In mounting the connector 10 to board 70, solder paste is typically screened onto the various termini 76,84,90. The free ends 38,54 of the terminal members 30,46 are aligned with their respective termini as the connector 10 is mounted to the board and secured thereto with holding means such as 66 and use of other alignment means such as pylons (not shown) and the like as known in the art. After mounting, the assembly of connector 10 and board 70 are heated such as for example in an infrared oven to reflow the solder fillets 78,86, and 92 and electrically connect and secure the respective surface mount contact sections 38, 54,and 58 to their respective termini 76,84, and 90, as shown in FIGS. 2 and 4. As can be seen in FIGS. 3 and 5 the enlarged surface mount free end 54 of the ground terminal members 46 provides access to the free end 54 to permit reworking of the solder connection should it become necessary.

In making the electrical connector 10 in accordance with the invention housing 12 is formed from a dielectric material such as for example, liquid crystal polymers, or polyphenylene sulfide, which are readily available from a number of commercial sources. Other suitable materials capable of withstanding the soldering temperatures associated with surface mount technology, as known in the art, may also be used. It should be recognized that the terminal members 30,46 of connector 10 may also be electrically connected to the respective circuit board termini 76,84 by means of conductive adhesive or other materials as known in the art. The dielectric material selected for the housing, therefore, would be one that is compatable with the conductive material selected and method used to interconnect the conductors to the board termini.

The signal terminal members 30 and ground terminal members 46 are stamped and formed from phosphor bronze or other materials having the desired spring characteristics to provide sufficient normal force.

As can be seen from the foregoing description, the abrupt change in the elongate arm 36 of the signal terminal member provides a means to surface mount a close array of terminal members to a board having a densely spaced array of inner and outer termini. The invention also provides for a means for maintaining the true position of a continuously extending ground contact or other terminal member.

In the embodiment shown, the present invention further provides the advantage of having only two different signal terminal members 30, one for the right hand row of the connector and the other for the left hand row of the housing and only one ground terminal member 46. The reduction in the number of different terminal members as compared to the ones used in the connectors of the prior art patents provides a more cost effective means of manufacturing the high-speed connector. The present invention allows for a closely spaced array of terminal members to be mounted to a surface of a circuit board thereby eliminating the need to provide a plurality of through holes in the board.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A surface mountable electrical connector for use with a circuit board of the type having an outer row of trace termini and an inner row of trace termini closely spaced therefrom on the mounting surface of said board, said connector comprising a dielectric housing having a mounting face and a mating face and at least one row of electrical terminal members extending therebetween, said terminal members arranged adjacent to each other and in a dense array in said at least one row with some of said terminal members being associated with said outer row of termini and others of said terminal members being associated with said inner row of termini, said terminal members including elongate arm portions extending from said housing and generally parallel to said mounting face thereof, at least each said terminal members associated with said outer row of termini including an intermediate portion extending at an angle from said elongate arm portion and generally away from said mounting face, said intermediate portion concluding in a surface mount contact section that extends generally parallel to said mounting face, said intermediate portion defining a surface facing said inner row of trace termini that is abruptly directed away from said mounting surface of said circuit board at least a selected distance above the spacing between said outer and inner rows of said termini to provide clearance above solder used to solder said surface mount contact section to a respective trace termini in said outer row thereby preventing solder from wicking to closely adjacent ones of said termini of said inner row.

2. The surface mountable electrical connector of claim 1 wherein said intermediate portion of each said terminal associated with said outer row of circuit board termini is of sufficient length to elevate said elongate portion above said circuit board a distance that is greater than the thickness of the terminal.

3. A surface mountable electrical connector of the type having terminal members with elongate arm portions with surface mounted contact sections for use with a circuit board of the type having at least one row of trace termini on the mounting surface of said board, said connector comprising a dielectric housing having a mounting face and a mating face and at least one row of electrical terminal members extending therebetween, said terminal members arranged adjacent to each other and in a dense array in said at least one row, said terminal members including elongate arm portions extending from said housing to surface mount contact sections at free ends thereof associated with a respective one of said trace termini of said circuit board, each said terminal member having a registration portion directed upwardly away from the mounting surface of the board, said registration portion being receivable in an associated recess extending into said mounting face of said housing and inwardly from a side surface of said housing, thereby maintaining the registration of said elongate arms and the accurate spacing of said surface mount contact sections during handling and mounting of said connector to said board and preventing inadvertent engagement with closely spaced contacts and misalignment with corresponding trace termini.

4. The surface mountable electrical connector of claim 3 wherein said terminal member is a ground terminal member, said ground terminal member including two elongate arm portions extending in opposite directions from said housing, each having a respective registration portion.

5. The surface mountable electrical connector of claim 4 wherein each said ground terminal member includes a board support section intermediate said two elongate arm portions.

6. The surface mountable electrical connector of claim 5 wherein said board support section is electrically connectable to ground termini on said board.

* * * * *